United States Patent [19]

Dole

[11] 4,205,911

[45] Jun. 3, 1980

[54] CLEANING SYSTEM

[75] Inventor: Otto R. Dole, Walworth, N.Y.

[73] Assignee: Xerox Corporation, Stamford, Conn.

[21] Appl. No.: 823,245

[22] Filed: Aug. 10, 1977

[51] Int. Cl.[2] ..... G03G 21/00; A46B 15/00; B21B 45/02

[52] U.S. Cl. ..... 355/15; 15/256.52; 15/308

[58] Field of Search ..... 355/3 R, 15; 118/652; 15/1.5 R, 1.5 A, 256.51, 256.52, 308

[56] References Cited

U.S. PATENT DOCUMENTS

| | | | |
|---|---|---|---|
| 3,917,397 | 11/1975 | Tanaka et al. | 355/15 |
| 3,942,889 | 3/1976 | Kurita et al. | 355/15 |
| 3,965,524 | 6/1976 | Kurita et al. | 355/15 X |
| 3,969,785 | 7/1976 | Ogawa et al. | 355/15 X |

FOREIGN PATENT DOCUMENTS

| | | | |
|---|---|---|---|
| 2331203 | 1/1974 | Fed. Rep. of Germany | 355/15 |

*Primary Examiner*—Fred L. Braun

[57] ABSTRACT

An apparatus in which residual particles are removed from a photosensitive member. A flow of gas is directed tangentially to the cleaner in the region wherein the cleaner engages the photosensitive member. The gas flow aids in the separation of the residual particles from the cleaner.

6 Claims, 2 Drawing Figures

CLEANING SYSTEM

BACKGROUND OF THE INVENTION

This invention relates generally to an electrophotographic printing machine, and more particularly concerns an improved cleaning system for use therein.

In the process of electrophotographic printing, a photoconductive surface is uniformly charged. The charged photoconductive surface is then irradiated with a light image of an original document. The light image projected onto the charged photoconductive surface selectively dissipates the charge to record thereon an electrostatic latent image of the original document. During development, toner particles are electrostatically attracted to the latent image rendering it visible. Subsequently, the toner powder image is trans-ferred from the photoconductive surface to a sheet of support material. The powder image is permanently affixed to the sheet of support material forming a copy of the original document thereon. The foregoing process is described in greater detail in U.S. Pat. No. 2,287,691, issued to Carlson in 1942.

Generally, residual toner particles remain adhering to the photoconductive surface after the transfer of the toner powder image to the sheet of support material. Hereinbefore, it has been the practice to use an A.C. voltage for neutralizing the photoconductive surface followed by the cleaning thereof with a rotating brush. This operation permits removal of the majority of the residual toner particles from the photoconductive surface. A vacuum system is frequently associated with the rotating brush for collecting the residual toner particles. The brush is rotated at a high speed, thereby loosening and removing the residual toner particles from the photoconductive surface. These loosened particles are withdrawn by the vacuum system into the collection bag. Such an apparatus is an efficient structure for the removal of residual toner particles from the photoconductive surface. However, constructions of this type increase costs and complexity making it difficult to produce a compact copying apparatus. Moreover, systems of this type are frequently inefficient and may result in marginal cleaning, or filming of the photoconductive surface. The air flow is frequently applied as much as 270° from the area to be cleaned. This can cause further brush contamination as the residual toner particles are being transported with the brush. In addition, air flow components exist in a radial direction toward the brush fiber roots. This prevents separation of the toner particles from the brush. Optimumly, the toner particles should be separated from the brush as soon as possible.

Accordingly, it is a primary object of the present invention to improve the cleaning apparatus of an electrophotographic printing machine.

PRIOR ART STATEMENT

Various types of devices have hereinbefore been developed to achieve cleaning improvements. The following prior art appears to be relevant:

Tanaka et al. - U.S. Pat. No. 3,917,397 - November 4, 1975

Kurita et al. - U.S. Pat. No. 3,942,889 - March 9, 1976

Kurita et al. - U.S. Pat. No. 3,965,524 - June 29, 1976

Ogawa et al. - U.S. Pat. No. 3,969,785 - July 20, 1976

The pertinent portions of the foregoing prior art may be briefly summarized as follows:

Tanaka et al. discloses a high speed rotating brush in frictional engagement with the periphery of a photoconductive drum. The rotating brush removes residual toner from the photoconductive drum and centrifugally discharges the toner into a passageway through which an induced air stream carries the toner to an oppositely charged rotating drum.

Kurita et al. ('889) discloses a brush engaging a photoconductive drum for removing residual toner particles therefrom . The brush hairs act as impellers causing air flow in the direction of rotation of the brush. The air and toner particles are carried toward a gap formed at the rear end of the brush in communication with an open portion above the receptacle bin. Upon being brought into the gap, the air and particles move outwards with respect to the brush and into the open portion due to centrifugal force. When the air has reached the central portion of the gap, the air strikes a transverse bar which dis-lodges any remaining toner particles both directly and by creating a turbulent air flow. These remaining toner particles also move, due to centrifugal force, into the open portion.

Kurita et al. ('524) discloses a brush contacting a photoconductive drum. The brush hairs are compressed by a restriction board causing the brush to act like a fan for recirculation of air and toner particles. As the toner particles are circulated, they are attracted to a plate with the heavier particles being thrown into a receiver. This enables the vacuum system to remove the toner particles from the cleaning system.

Ogawa et al. discloses a brush contacting a photoconductive drum for removing toner particles therefrom. Simultaneously, the rotation of the fan draws air through a gap in the direction of rotation of the brush. The toner particles adhering to the brush are discharged from the bristles when the brush strikes a flicker rod. The air flow carries the toner particles into a filter.

It is believed that the scope of the present invention, as defined by the appended claims, is clearly patentably distinguishable over the foregoing prior art taken either singly or in combination with one another.

SUMMARY OF THE INVENTION

Briefly stated, and in accordance with the features of the present invention, there is provided an apparatus for removing residual particles from a photosensitive member.

Pursuant to the present invention, there is provided means, in engagement with the photosensitive member, for cleaning residual particles from the surface thereof. Means direct a flow of gas substantially tangential to the cleaning means in the region wherein the cleaning means engage the photosensitive member. In this manner, residual particles are separated from the cleaning means.

BRIEF DESCRIPTION OF THE DRAWINGS

Other objects and advantages of the present invention will become apparent upon reading the following detailed description and upon reference to the drawings, in which.

While the present invention will be described in connection with a preferred embodiment thereof, it will be understood that it is not intended to limit the invention to that embodiment. On the contrary, it is intended to cover all alternatives, modifications and equivalents as may be included within the spirit and broad scope of the invention as defined by the appended claims.

DETAILED DESCRIPTION OF THE INVENTION

Figure 1:
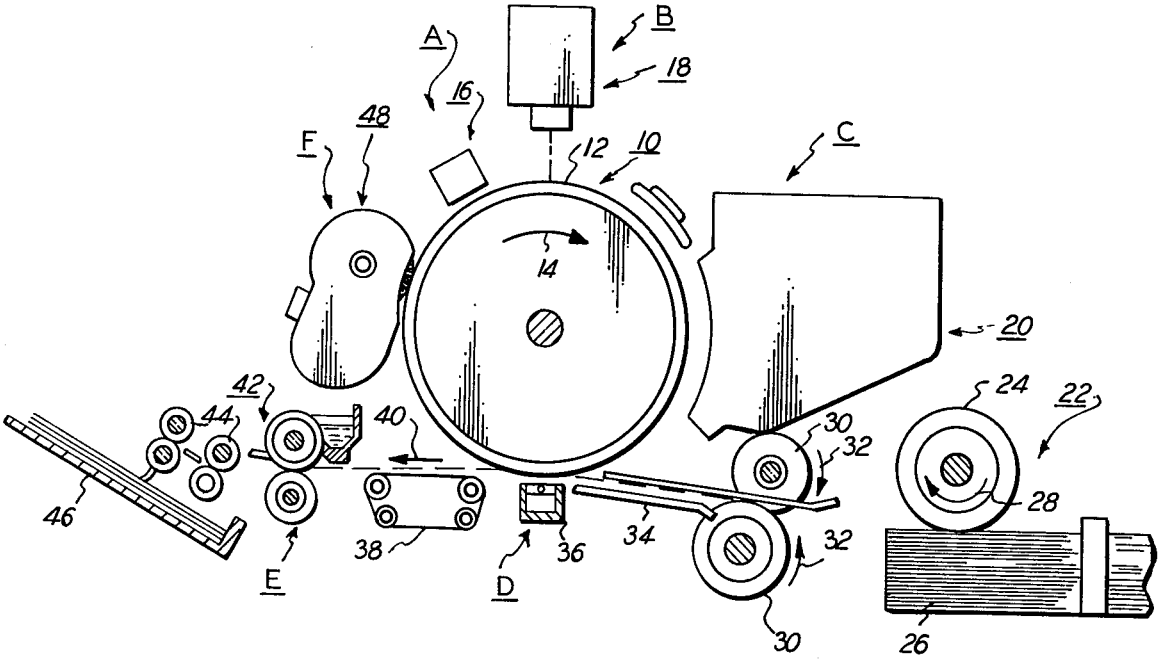
FIG. 1 depicts a schematic elevational view of an electrophotographic printing machine incorporating the features of the present invention therein.

For a general understanding of an electrophotographic printing machine in which the features of the present invention may be incorporated, reference is had to FIG. 1 which depicts schematically the various components thereof. Hereinafter, like reference numerals will be employed throughout to designate identical elements. Although the cleaning apparatus of the present invention is particularly well adapted for use in electrophotographic printing, it should become evident from the following discussion that it is equally well suited for use in a wide variety of devices and is not necessarily limited in its application to the particular embodiment shown herein.

Inasmuch as the practice of electrophotographic printing is well known in the art, the various processing stations for producing a copy of an original document are represented in FIG. 1 schematically. Each processing station will be discussed briefly hereinafter.

As in all electrophotographic systems of the type illustrated, a drum 10 having photoconductive surface 12 entrained about and secured to the exterior circumferential surface of a conductive substrate is rotated, in the direction of arrow 14, through the various processing stations. One type of suitable photoconductive material is described in U.S. Pat. No. 2,970,906 issued to Bixby in 1961. Preferably, the conductive substrate is made from aluminum.

Initially, drum 10 rotates a portion of photoconductive surface 12 through charging station A. Preferably, charging station A utilizes a corona generating device, indicated generally by the reference numeral 16, to sensitize photoconductive surface 12. Corona generating device 16 is positioned closely adjacent to photoconductive surface 12. When energized, corona generating device 16 charges at least a portion of photoconductive surface 12 to a relatively high substantially uniform potential. For example, corona generating device 16 may be of the type described in U.S. Pat. No. 2,836,725 issued to Vyverberg in 1958.

Thereafter, drum 10 rotates the charged portion of photoconductive surface 12 to exposure station B. Exposure station B includes an exposure mechanism, indicated generally by the reference numeral 18, having a stationary, transparent platen, such as a glass plate or the like, for supporting an original document thereon. Scan lamps illuminate the original document. Scanning of the original document may be achieved by oscillating a mirror in a timed relationship with the movement of drum 10. This mirror is positioned beneath the platen to reflect the light image of the original document through a lens onto a mirror, which, in turn, transmits the light image through an apertured slit onto the charged portion of photoconductive surface 12. Irradiating the charged portion of photoconductive surface 12 selectively discharges the charge thereon to record an electrostatic latent image corresponding to the informational areas contained within the original document.

Drum 10 next rotates the electrostatic latent image recorded on photoconductive surface 12 to development station C. Development station C includes a developer unit, indicated generally by the reference numeral 20, having a housing with a supply of developer mix contained therein. Preferably, the developer mix comprises carrier granules having toner particles adhering triboelectrically thereto. Developer unit 20 is a magnetic brush type development system. In a system of this type, the developer mix is brought through a directional flux field to form a brush thereof. The elecrostatic latent image recorded on photoconductive surface 12 is developed by bringing the brush of developer mix into contact therewith. During development, the toner particles are attracted from the carrier granules to the latent image. In this manner, a powder image is formed on photoconductive surface 12.

With continued reference to FIG. 1, a sheet of support material is advanced by sheet feeding apparatus 22 to transfer station D. Sheet feeding apparatus 22 includes a feed roll 24 contacting the uppermost sheet of the stack of sheets of support material 26. Feed roll 24 rotates in the direction of arrow 28 so as to advance the uppermost sheet from stack 26. Registration rollers 30, rotating in the direction of arrow 32, align and forward the advancing sheet of support material into chute 34. Chute 34 directs the advancing sheet of support material into contact with drum 10 and a timed sequence so that the powder image developed thereon contacts the advancing sheet of support material at transfer station D.

At transfer station D, corona generating device 36 applies a spray of ions to the backside of the sheet of support material. This attracts the powder image from photoconductive surface 12 to the sheet of support material. After transfer, the sheet is separated from photoconductive surface 12 and advanced by conveyor 38 in the direction of arrow 40 to fusing station E.

Fusing station E includes a fuser assembly, indicated generally by the reference numeral 42. Fuser assembly 42 permanently affixes the transferred toner powder image to the sheet of support material. After the toner powder image is permanently affixed to the sheet of support material, the sheet of support material is advanced by a series of rollers 44 to catch tray 46 for subsequent removal therefrom by the machine operator.

Invariably, after the sheet of support material is stripped from photoconductive surface 12 of drum 10, some residual toner particles remain adhering to photoconductive surface 12. These residual toner particles are removed from photoconductive surface 12 at cleaning station F. Cleaning station F includes a cleaning system, indicated generally by the reference numeral 48. The particles are cleaned from photoconductive surface 12 by a rotatably mounted fibrous brush in contact therewith. Subsequent to cleaning, a discharge lamp (not shown) floods photoconductive surface 12 with light to dissipate any residual electrostatic charge remaining thereon prior to the charging thereof for the next successive imaging cycle. The detailed structure of cleaning system 48 will be described hereinafter with reference to FIG. 2.

It is believed that the foregoing description is sufficient for purposes of the present application to illustrate the general operation of an electrophotographic printing machine. Referring now to the specific subject matter of the present invention, FIG. 2 depicts cleaning system 48 in greater detail.

Figure 2:
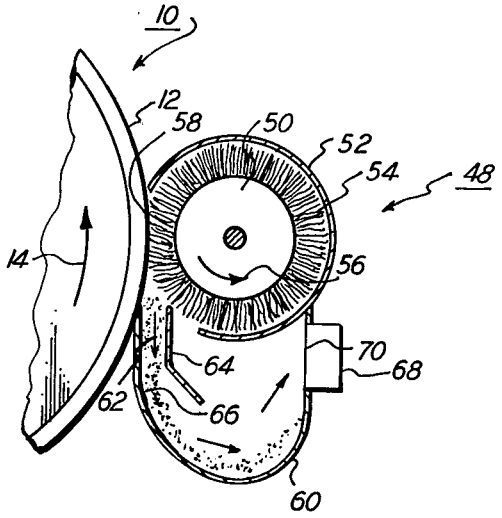
FIG. 2 illustrates a fragmentary elevational view of a cleaning system employed in the FIG. 1 printing machine.

Turning now to FIG. 2, there is shown the detailed structure of cleaning system 48. As depicted therein, cleaning system 48 comprises a hub 50 mounted rotatably in housing 52. Preferably, hub 50 is made from a suitable rigid structure such as plastic or metal and has a plurality of brush fibers 54 extending in an outwardly direction therefrom. A motor (not shown) rotates hub 50 in the direction of arrow 56. Fibers 54 engage photoconductive surface 12 of drum 10 in cleaning region 58. The leading marginal portions of fibers 54 are deflected in a backwardly direction, i.e. opposed from the direction of rotation as they contact photoconductive surface 12 in region 58. Thus, there is a flicking action as the fibers 54 move out of engagement with photoconductive surface 12. This flicking action tends to separate toner particles from brush 54. Hence, the toner particles are removed from photoconductive surface 12 by fibers 54 in region 58 as they move into engagement therewith. Thereafter, fibers 54 move out of regions 58, and no longer contact photoconductive surface 12. As fibers 54 move away from photoconductive surface 12, they tend to flick the toner particles in a direction substantially tangential to the direction of rotation of hub 50 in region 58. Thus, toner particles are flicked in a straight line substantially tangential to photoconductive surface 12 and fibers 54 in region 58. A collecting housing 60 is positioned beneath brush fibers 54 to receive the toner particles separated therefrom.

In order to facilitate separation of the toner particles from brush fibers 54, gas or air passes through fibers 54 in the direction of arrow 62. Thus the flow of gas or air is substantially tangential to fibers 54 in region 58. Baffle plates 64 in cooperation with side wall 66 of collecting housing 60 forms a chute for directing the gas or air flow. As air moves in the direction of arrow 62, it aids in the separation of the toner particles from fibers 54. Thus, the direction of air flow is in the same direction as the brush fibers flick the toner particles. This facilitates the natural tendency of the toner particles to separate from fibers 54 in region 58, i.e. in a direction substantially tangential thereto. A vacuum system continually removes air from collecting means 60 so as to form the flow of air in the direction of arrow 62. This is achieved by a blower 68 drawing air outwardly through filter 70 disposed in collecting housing 60.

The air entrained toner particles dislodged from brush fibers 54, after fibers 54 exit region 58, are directed in the direction of arrow 62. The direction of air flow is regulated by plate 64 cooperating with side wall 66. In this way, the air laden toner particles are effectively sucked through filter 70 by the suction forces created by blower 68.

By way of example, baffle plate 64 may be a suitable sheet of metal configured in the desired shape so as to ensure that air flows in the direction of arrow 62 substantially tangential to fibers 54 in the region of contact with photoconductive surface 12, i.e. region 58. Preferably, brush fibers 54 are formed from an artificial or natural fiber such as Dynel. The brush is rotated at about 500 to 1000 revolutions per minute. Preferably, filter 70 comprises a non-woven fabric such as acetate, propylene or the like, and is of a highly dense structure so as to collect the toner particles passing therethrough on the air flow. A motor in association with a fan forms blower 68. The motor drives the fan so that the air flow is in the direction of arrow 62.

In this manner, the air flow separates the toner particles from brush fibers 54. As previously noted, air flow is substantially tangential to the brush fibers in the region wherein the brush fibers engage photoconductive surface 12. The toner particles separated from brush fibers 54 are stored in the chamber of housing 60. Substantially no air flow is directed inwardly or in a radial direction towards the roots of the brush fibers. Air flow in this direction tends to cause the toner particles to remain adhering to fibers 54. Contrawise, air flows substantially tangential to fibers 54 causes the toner particles to be separated therefrom. By preventing toner particles from remaining adhering to fibers 54, photoconductive surface 12 remains substantially free therefrom and fibers 54 do not subsequently, form a film of toner on photoconductive surface 12.

While the invention has been described in connection with a brush, one skilled in the art will appreciate that the invention is not necessarily so limited and that a blade or foam roll cleaner may be employed in lieu thereof. In both of the latter embodiments, the direction of air flow is also substantially tangential to photoconductive surface 12 in the region of contact therewith. Thus, the air flow moves in a direction tangential to photoconductive surface 12 in the region of engagement with the foam roller. In this way, the air flow is substantially tangential to the foam roller as well as photoconductive surface 12. Similarly, the direction of air flow is normal to the plane of a blade or once again, substantially tangential to photoconductive surface 12 in the region wherein the blade is in engagement therewith.

It is, therefore, evident that the direction of air flow is such as to separate the toner particles from the cleaner by facilitating the movement of the toner particles in the direction they naturally tend to move. For example, the brush fibers tend to flick the toner particles tangential to the brush. Similarly, the roller would tend to move the toner substantially tangential to the surface thereof. Finally, the blade would tend to move the toner particles substantially tangential to the blade plane. Thus, the air flow facilitates or aids in the movement of the toner particles in this direction. This greatly improves separation of the toner particles from the cleaning structure.

In recapitulation, it is evident that the apparatus of the present invention cleans residual toner particles from a photoconductive surface after the transfer thereof to a copy sheet. Moreover, the apparatus separates the residual toner particles from the cleaning structure so as to prevent subsequent reapplication of the toner particles to the photoconductive surface. The foregoing separation is facilitated by applying a flow of gas in a direction substantially tangential to the cleaning apparatus in the region wherein the cleaning apparatus engages the photoconductive surface. This significantly improves cleaning of the photoconductive surface and prevents the subsequent re-application of toner particles thereto.

It is, therefore, evident that there has been provided, in accordance with the present invention, a cleaning system that fully satisfies the objects, aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. An apparatus for removing residual particles from a photosensitive member, including in combination:

means, in engagement with the photosensitive member, for cleaning residual particles from the surface thereof, wherein said cleaning means includes a rotatable mounted cleaning brush having bristles thereon in contact with the photosensitive member;

means for directing a flow of gas substantially tangential to said cleaning means in the region at which said cleaning means engages the photosensitive member to separate the residual particles from said cleaning means, wherein said flow of gas is directed at the outer periphery of said brush bristles away from the roots of said bristles; and means for collecting residual particles separated from said cleaning means, said cleaning means being disposed in said collecting means.

2. An apparatus as recited in claim 1 wherein said flow directing means includes:

a blower coupled to said collecting means for producing a flow of gas; and a baffle plate mounted in said collecting means for directing the flow of gas in a direction substantially tangential to said cleaning means in the region wherein said cleaning means engages the photosensitive member.

3. An apparatus as recited in claim 2 further including means for filtering the residual particle laden gases so that the residual particles remain in said collecting means as the gas passes therefrom.

4. An electrophotographic printing machine of the type having toner particles deposited on a photoconductive member in image configuration with the toner particles being transferred from the photoconductive member to a copy sheet, wherein the improvement includes in combination:

means, in engagement with the photoconductive member, for cleaning residual toner particles from the surface thereof, wherein said cleaning means includes a rotatably mounted cleaning brush having bristles thereon in contact with the photoconductive member;

means for directing a flow of gas substantially tangential to said cleaning means in the region wherein said cleaning means engages a photoconductive member to separate the residual particles from said cleaning means, wherein said flow of gas is directed at the outer periphery of said brush bristles away from the roots of said bristles; and means for collecting residual toner particles separated from said cleaning means, said cleaning means being disposed in said collecting means.

5. A printing machine as recited in claim 4, wherein said flow directing means includes:

a blower coupled to said collecting means for producing a flow of gas; and a baffle plate mounted in said collecting means for directing the flow of gas in a direction substantially tangential to said cleaning means in the region wherein said cleaning means engages the photoconductive member.

6. A printing machine as recited in claim 5, further including means for filtering the residual toner particle laden gas so that the residual toner particles remain in said collecting means as the gas passes therefrom.

* * * * *